US011083230B2

(12) United States Patent
Gibson

(10) Patent No.: US 11,083,230 B2
(45) **Date of Patent: *Aug. 10, 2021**

(54) APPAREL ARTICLE WITH INTEGRAL PRE-WORN DESIGN ELEMENTS

(71) Applicant: Greg Gibson, Lake Forest, IL (US)

(72) Inventor: Greg Gibson, Lake Forest, IL (US)

( * ) Notice: Subject to any disclaimer, the term of this patent is extended or adjusted under 35 U.S.C. 154(b) by 59 days.

This patent is subject to a terminal disclaimer.

(21) Appl. No.: 16/287,751

(22) Filed: Feb. 27, 2019

(65) Prior Publication Data

US 2019/0191789 A1 Jun. 27, 2019

Related U.S. Application Data

(60) Continuation of application No. 14/630,279, filed on Feb. 24, 2015, now Pat. No. 10,244,802, which is a continuation of application No. 13/271,963, filed on Oct. 12, 2011, now abandoned, which is a division of application No. 12/235,733, filed on Sep. 23, 2008, now abandoned.

(51) Int. Cl.
*A41D 1/04* (2006.01)
*A41D 27/08* (2006.01)

(52) U.S. Cl.
CPC ..... *A41D 1/04* (2013.01); *A41D 27/08* (2013.01)

(58) Field of Classification Search
None
See application file for complete search history.

(56) References Cited

U.S. PATENT DOCUMENTS

| | | | |
|---|---|---|---|
| RE8,093 | E | 2/1878 | Woodward |
| 1,204,719 | A | 11/1916 | Van Heusen |
| 1,367,182 | A | 2/1921 | Gardi |
| 1,405,405 | A | 2/1922 | Gendel |
| 1,476,831 | A | 12/1923 | Pease |
| 2,252,884 | A | 8/1941 | Fellroth |
| 3,484,974 | A | 12/1969 | Culmone |
| 4,776,043 | A | 10/1988 | Coleman |
| D333,030 | S | 2/1993 | Wilkes |
| 5,293,648 | A | 3/1994 | Finley |
| 5,359,733 | A | 11/1994 | Brannon |

(Continued)

OTHER PUBLICATIONS

Upper Deck Sports, Tips on Collecting—The Differences in Sets & Card Types, Aug. 31, 2006, http://sports.upperdeck.com/collectorszone/tips/tips_setcardtypes.aspx?visited=1, pp. 1-6 (Year: 2006).*

(Continued)

*Primary Examiner* — John Van Bramer
(74) *Attorney, Agent, or Firm* — Fitch, Even, Tabin & Flannery LLP

(57) ABSTRACT

This disclosure generally relates to an apparel article, such as an article of clothing, that includes a pre-worn piece as a design element integral with the article of clothing. The pre-worn piece may be, for example, a cut-out of an athletic jersey, a uniform, a shirt or the like, formed in a particular design pattern, that was worn by a member of a sports team such as a professional sports team. In another aspect, the disclosure relates to a method for marketing an article or articles in a line of apparel, such as sporting goods apparel, with such pre-worn pieces affixed to the articles as integral design elements.

9 Claims, 5 Drawing Sheets

(56) References Cited

U.S. PATENT DOCUMENTS

| | | | | |
|---|---|---|---|---|
| 5,359,734 | A | 11/1994 | Rathburn | |
| 5,803,501 | A | 9/1998 | Gluck | |
| D402,442 | S | 12/1998 | Irwin | |
| 6,023,789 | A | 2/2000 | Wilson | |
| 6,142,532 | A | 11/2000 | Gluck | |
| D465,316 | S | 11/2002 | Turney | |
| 6,475,634 | B1 * | 11/2002 | Lam | A47G 33/00 156/60 |
| D467,706 | S | 12/2002 | Thompson | |
| 6,519,779 | B1 | 2/2003 | Taguchi | |
| 6,701,533 | B2 | 3/2004 | Webb | |
| 6,782,554 | B1 | 8/2004 | Froehlich | |
| 6,782,559 | B2 | 8/2004 | Regan | |
| 6,848,118 | B2 | 2/2005 | Barnes | |
| D521,211 | S | 5/2006 | Park | |
| 7,496,973 | B2 | 3/2009 | Jewell | |
| D612,131 | S | 3/2010 | Brown | |
| D631,230 | S | 1/2011 | Ruffini | |
| D674,579 | S | 1/2013 | Grabowski | |
| D714,522 | S | 10/2014 | Boyer | |
| D821,706 | S | 7/2018 | Airhart | |
| D833,714 | S | 11/2018 | Airhart | |
| D843,686 | S | 3/2019 | Keppler | |
| 2002/0062510 | A1 | 5/2002 | Mullen | |
| 2002/0108189 | A1 | 8/2002 | Kahl | |
| 2003/0130912 | A1 | 7/2003 | Davis | |
| 2005/0017501 | A1 * | 1/2005 | Gluck | B42D 15/00 283/72 |
| 2007/0083970 | A1 | 4/2007 | Turney | |
| 2007/0157358 | A1 | 7/2007 | Sharon | |
| 2007/0200929 | A1 * | 8/2007 | Conaway, Jr. | G06Q 10/087 348/157 |
| 2008/0307556 | A1 | 12/2008 | Turney | |
| 2009/0064919 | A1 | 3/2009 | Greenwald | |
| 2009/0223427 | A1 | 9/2009 | Turney | |
| 2010/0024100 | A1 | 2/2010 | Sokolowski et al. | |
| 2010/0058511 | A1 | 3/2010 | Lee | |
| 2010/0071109 | A1 | 3/2010 | Gibson | |
| 2010/0307035 | A1 | 12/2010 | Malone | |
| 2015/0164150 | A1 | 6/2015 | Gibson | |

OTHER PUBLICATIONS

Upper Deck Sports, Tips ond Collecting—The Differences in Sets & Card Types, Aug. 31, 2006, http://sports.upperdeck.com/collectorszone/tips/tips_setcardtypes.aspx?visited=1, pp. 1-6 (Year: 2006).*

Upper Deck Sports, Tips on Collecting—Game-Used Memorabilia Cards, Aug. 13, 2006, http://sports.upperdeck.com/ collectorszone/tips/tips_setcardtypes.aspx?visited=1, p. 1-2, 2006.

Upper Deck Sports, Tips on Collecting—The Differences in Sets & Card Types, Aug. 31, 2006, http://sports.upperdeck.com/ collectorszone/tips/tips_setcardtypes.aspx?visited=1, pp. 1-6 , 2006.

* cited by examiner

APPAREL ARTICLE WITH INTEGRAL PRE-WORN DESIGN ELEMENTS

CROSS REFERENCE TO RELATED APPLICATIONS

This application is a continuation of U.S. application Ser. No. 14/630,279 filed Feb. 24, 2015, which is a continuation of U.S. application Ser. No. 13/271,963 filed Oct. 12, 2011, which is a division of U.S. application Ser. No. 12/235,733 filed Sep. 23, 2008, all of which are hereby incorporated herein by reference in their entireties.

TECHNICAL FIELD

This patent disclosure relates generally to sporting apparel, and, more particularly to sporting apparel that includes integral pre-worn design elements affixed thereto.

BACKGROUND

The widespread popularity of sporting apparel has increased in the past several years. This is due, in part, to the comfort such clothing items afford the wearer. Such popularity may perhaps further be attributed to an overall reduction in the use of formal wear. In any event, sporting apparel has generally become an attire of choice. For this reason, many clothing manufacturers have attempted to market such apparel to a mass audience. As an example, manufacturers sometimes provide marketing programs that are tailored to specific audiences or age groups to promote such apparel. Many sporting apparel manufacturers have engaged professional athletes or teams to promote clothing items.

Sports items with hidden memorabilia are described in published application No. US20050017501A1, entitled "Sports Items With Hidden Memorabilia," in the name of Adrian Gluck. This application describes providing items of historic or celebrity memorabilia concealed within certain specially designed areas of various "carriers" including shoes, hats, gloves, clothing articles and the like. In this way, the celebrity item or the like is protected and concealed until the consumer purchases the product. While this arrangement is useful for certain purposes such as providing a tamper-proof arrangement, the memorabilia items are concealed from view.

SUMMARY

The disclosure describes, in one aspect, an apparel article includes having at least one pre-worn piece affixed thereto in visible form. That is, the pre-worn piece forms a design element that is integral with the apparel article. The apparel article also has an emblem affixed thereto that provides a provenance for the pre-worn piece or pieces.

In another aspect, the disclosure describes a method for marketing a line of clothing. According to the method, a first apparel article includes a first pre-worn piece that is formed as an integral design element. The method provides a second apparel article that is complementary to the first article. The second article includes a second pre-worn piece that is complementary to the first pre-worn piece. In one embodiment, the second pre-worn piece is formed from the same or a similar pre-worn item as the pre-worn item used to form the first pre-worn piece and is of substantially the same size and shape as the first pre-worn piece. In this way, the design element of the first apparel article is complementary to the design element of the second apparel article.

BRIEF DESCRIPTION OF THE DRAWING(S)

DETAILED DESCRIPTION

This disclosure generally relates to an apparel article, such as an article of clothing. The article includes a pre-worn piece that is formed as a design element integral with the article of clothing. The pre-worn piece may be, for example, a cut-out of an athletic jersey, formed in a particular design pattern. The cut-out may be from a jersey or other clothing article that was actually worn by a member of a sports team such as a professional sports team in an athletic event. Alternatively, the cut-out may be formed from many other pre-worn items, such as the shirt of a professional golfer that was worn in a tournament or other event. While these are examples of the types of pre-worn clothing articles that may be used, this disclosure contemplates other pre-worn articles, such as those worn by NASCAR racing team members, alternative sports enthusiasts such as skateboard riders and the like. In another aspect, the disclosure relates to a method for marketing an article or articles in a line of apparel, such as sporting goods apparel. The line of clothing includes a plurality of clothing articles, each of which includes such a pre-worn piece affixed to the articles as an integral design element thereof. In this way, multiple clothing articles may be cross-marketed together.

Figure 1:
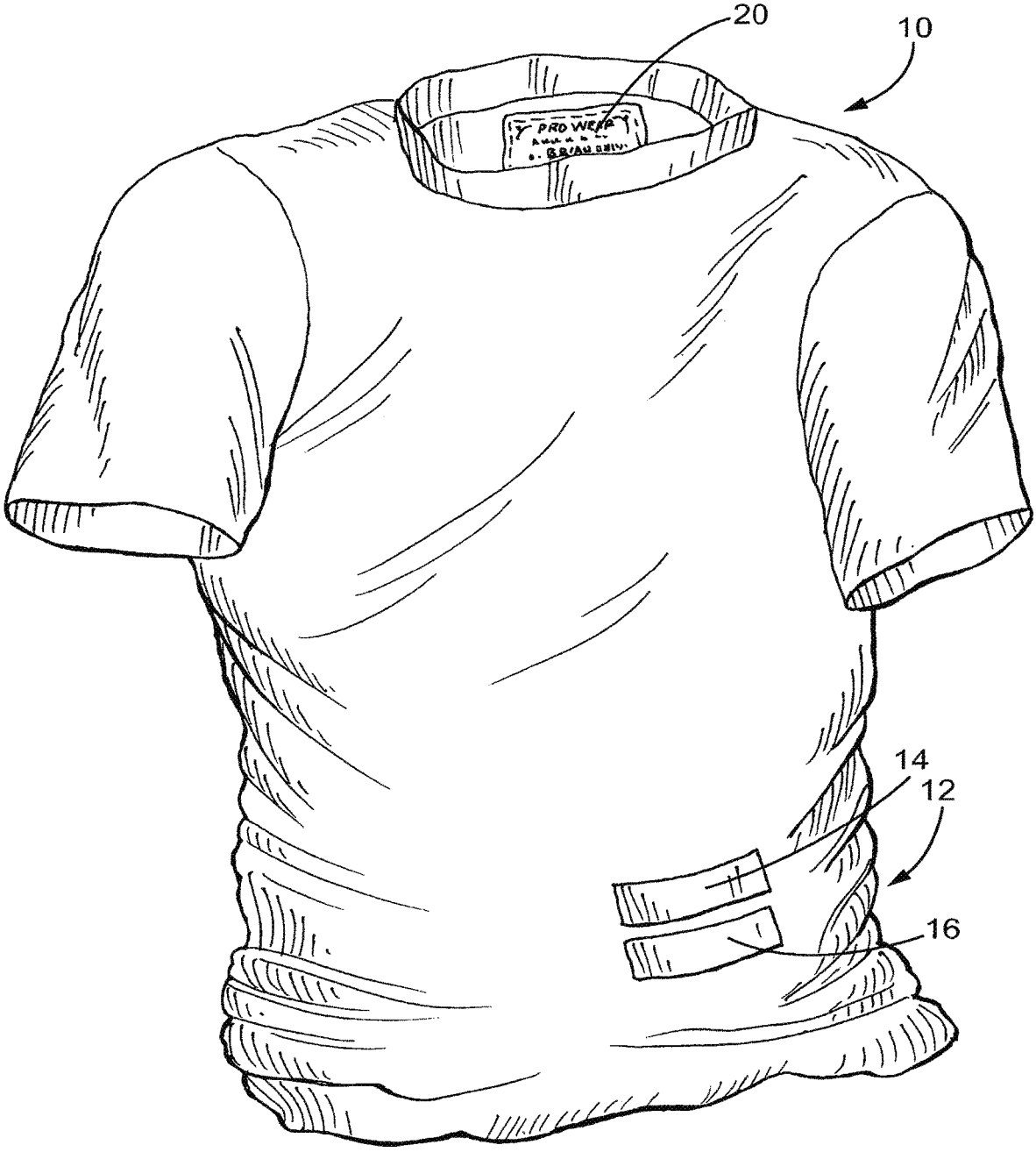
FIG. 1 is a perspective view of an apparel article having a pre-worn piece formed as a design element on the apparel article.

FIG. 1 illustrates an apparel article 10 according to the disclosure. In this case, apparel article is a jersey or tee shirt defined by a suitable body portion that conventionally may cover most of an individual's torso, a pair of opposed sleeves depending therefrom, and a collarless neck portion attached to the body portion. The jersey may be worn by an adult, youth or a small child. While not required, the jersey may be styled in a particular form, such as a football jersey with appropriate stitching, coloration, striping and the like.

In the illustrated embodiment, the apparel article 10 includes at least one design element 12. The design element 12 is defined by a first and second opposed pre-worn pieces 14 and 16. The first and second pre-worn pieces 14 and 16 are formed as spaced-apart, generally parallel striped portions that are integrally attached to the apparel article 10. In this embodiment, the pre-worn pieces 14 and 16 are located on the lower body portion of the article 10. As explained in greater detail below, the pre-worn pieces 14 and 16 may be cut-out portions taken from one or more pre-worn jerseys or other clothing items that have been worn by a particular athlete or sports team member of interest. For example, these pieces 14 and 16 may be created from the cloth of the jersey of a professional football player that was worn in a particular game. Alternatively, the pre-worn pieces may have originated from the jersey worn by a player in a practice or an exhibition event. In any of these instances, the fact that the player has actually worn the article from which the pre-worn pieces 14 and 16 are made enhances the demand for, and the value of, the article 10.

While the pre-worn pieces 14 and 16 are taken from an article worn by a professional athlete in one preferred embodiment, such pieces may not necessarily be from such an article. For example, the pieces may originate from practice jerseys of a professional or amateur team, or they can be made from the jersey or other clothing item worn by an amateur athlete. Not only will the cost for such pre-worn items likely be less, the clothing articles made with design elements from such pre-worn articles may be more particularly marketed to specific geographic regions.

Importantly, the pre-worn pieces 14 and 16 form integral design elements that are an actual element of the design of the article. For example, the pre-worn pieces 14 and 16, which in an illustrated embodiment provide spaced apart striped portions, may be of a contrasting color with remaining aspects of the article of clothing. That is, while the article may be in a predominantly first color of the team colors of a professional team, the pre-worn pieces 14 and 16 may be cut out of a worn jersey of a second color of the team colors of a professional team. As an example, for a clothing article that is intended to be marketed to a fan of the Chicago Bears football team, the article 10 shown in FIG. 1 may be predominantly navy blue in color, while the pre-worn pieces 14 and 16 may be taken from a pre-worn orange jersey. Alternatively, the pre-worn piece 14 or pieces 14, 16 may be formed as a logo. The logo may be a team logo or the logo of a sporting goods manufacturer that is marketing the apparel article 10.

Because the pre-worn pieces 14, 16 are cut from a jersey that was actually worn by a participant in a sporting event, their texture may be somewhat different than the texture of the article 10. Also, the textures (and coloration) of pre-worn pieces may differ from piece to piece. For example, the texture of the pre-worn pieces may be a mesh or otherwise. In many cases, however, such differences enhance the design element of these items in the overall design of the article. That is, while articles of the same general type may be of the same general overall design, each article preferably has slight variation in the constituency of the pre-worn pieces that form an integral part of such article.

In some instances, the pre-worn piece may be formed from different aspects of the pre-worn item. For example, certain of the pre-worn pieces of an item may be formed from any numbering, lettering, logo or other portion of the pre-worn item. This uniqueness in the consistency of the pre-worn pieces may further enhance the value of the article.

Figure 4:
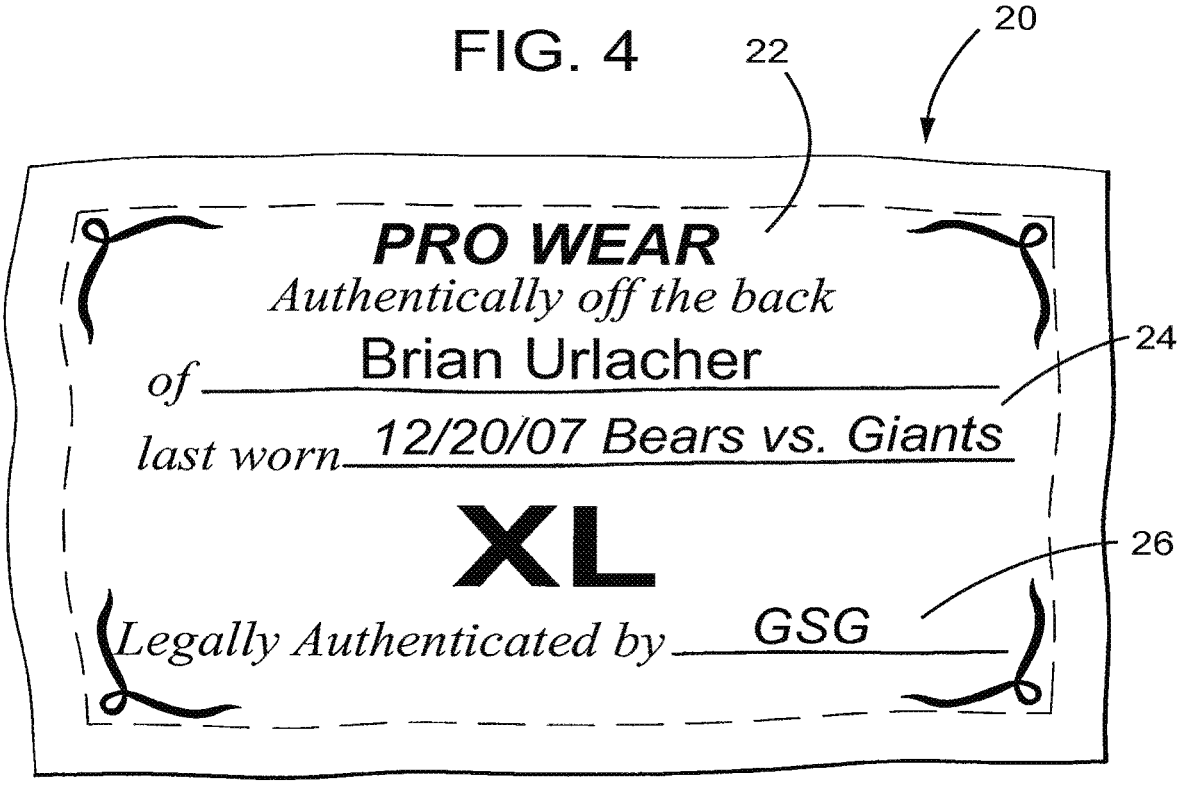
FIG. 4 is a front view of an emblem affixed to the apparel article shown in FIG. 1.

The apparel article 10 further includes a provenance portion 20. As best seen in FIG. 4, the provenance portion 20 provides certain information concerning the pre-worn pieces 14 and 16. Such information may include an identifier 22 that indicates the name of the athlete who wore the article from which the pre-worn pieces 14 and 16 were taken. In addition, the provenance portion 20 may include other historical information concerning the pre-worn pieces, such as game identification information 24 in which the athlete wore the article. Finally, the provenance portion 20 may include authenticity indicia 26 that designates the entity who authenticated the pre-worn portions 14 and 16. As explained below, however, this and other information may be provided in various ways without departing from the scope and spirit of the disclosure.

In the illustrated embodiment, the provenance portion 20 is permanently affixed onto the article 10. In this case, the provenance portion 20 is a tag that is stitched onto the inside of the apparel article 10 below the collar. The provenance portion 20 may be affixed to any other location on the inner part of the apparel article 10 that the consumer may expect to view information concerning the apparel article 10. Alternatively, the provenance portion 20 may be located on the exterior of the article 10.

Figure 2:
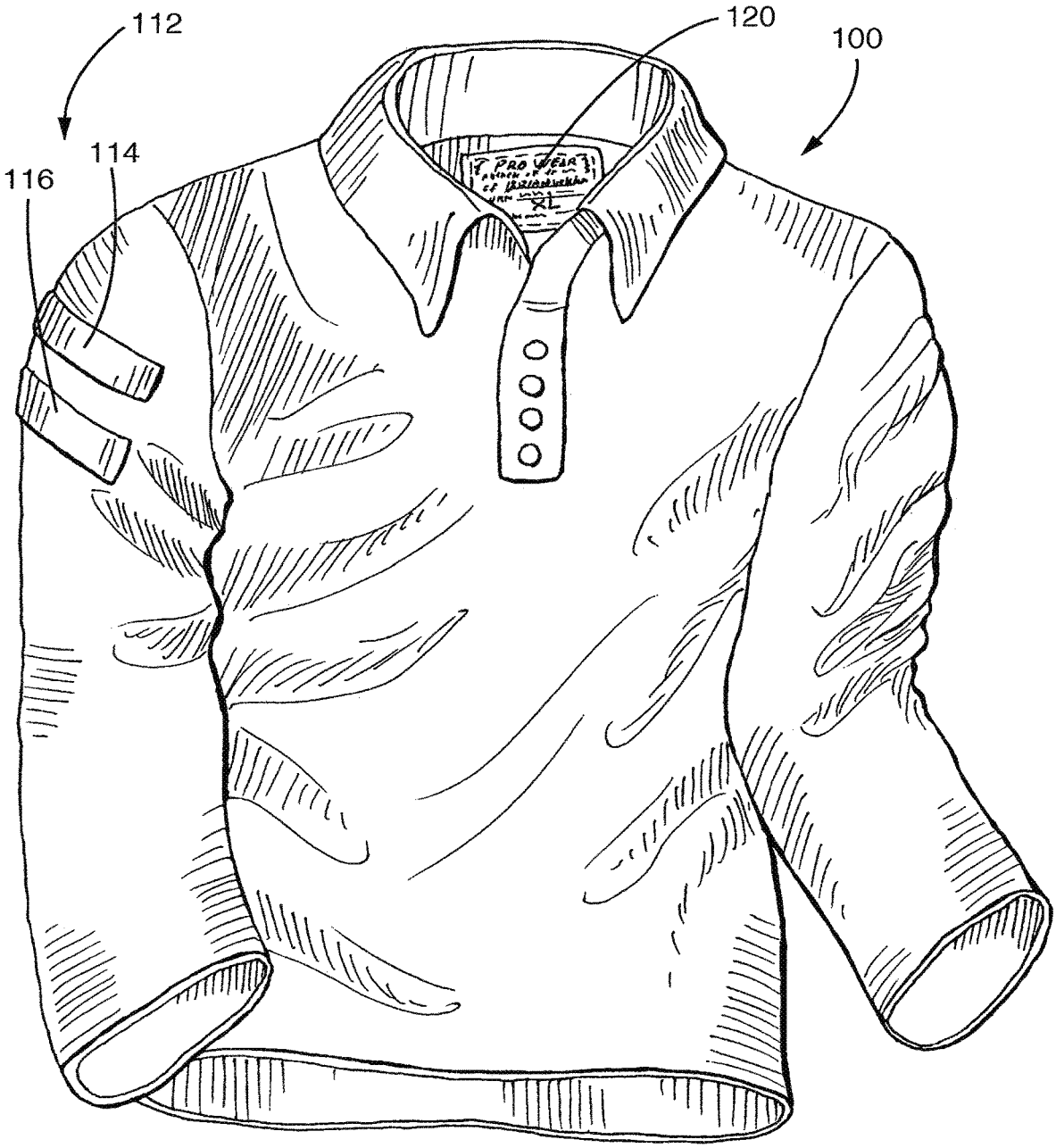
FIG. 2 is a perspective view of another apparel article having a pre-worn piece formed as a design element on the apparel article.

FIG. 2 illustrates a second apparel article 100 according to the disclosure. In this case, the apparel article 100 is a collared long-sleeve shirt. The apparel article 100 includes a pre-worn design element 112. As in the embodiment shown in FIG. 1, the pre-worn design element 112 includes first and second striped portions 114 and 116, arranged in parallel, spaced relation. However, in the embodiment shown in FIG. 2, the design element 112 is located on a sleeve of the article 110 in the proximity of the shoulder area. Preferably, the pieces 114 and 116 that form the design element 112 are of a contrasting color as compared to the predominant coloration of the article 100. The article 100 also includes a provenance portion 120 that is similar to the provenance 20 illustrated in FIGS. 1 and 4.

Figure 3:
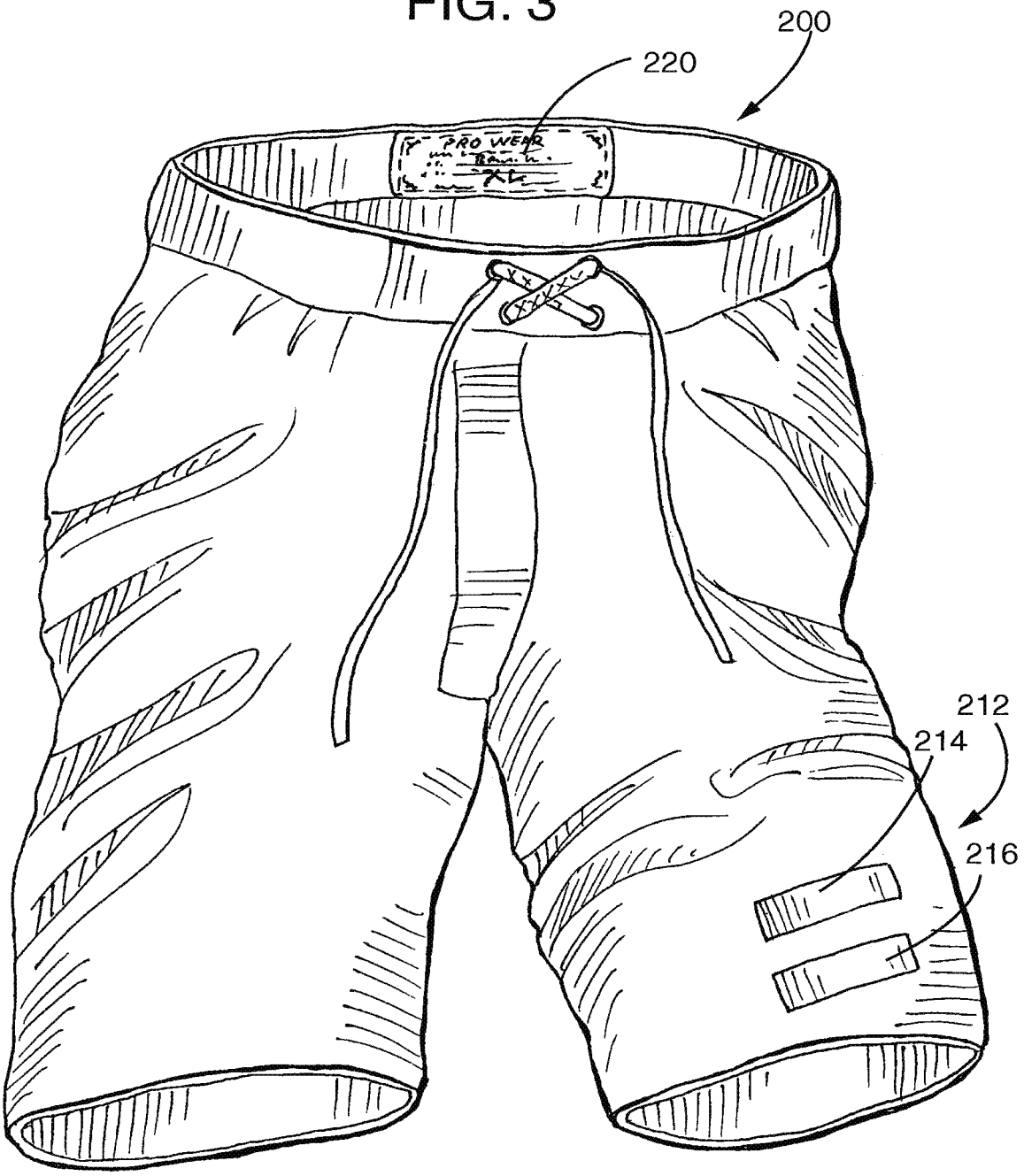
FIG. 3 is a perspective view of a further apparel article having a pre-worn piece, complementary to the pre-worn piece shown in FIG. 1, formed as a design element on the further apparel article.

Similarly, FIG. 3 illustrates a third apparel article 200 according to the disclosure. In this case, the apparel article 200 is a pair of pants. The apparel article 200 includes a pre-worn design element 212. As in the embodiment shown in FIG. 1, the pre-worn design element 212 includes first and second striped portions 214 and 216, arranged in parallel, spaced relation. The apparel article 200 also includes a provenance portion 220, which is also the same as the provenance illustrated in FIGS. 1 and 4.

The disclosure contemplates various ways in which to market the pre-worn design elements with apparel items. For example, the apparel articles may be promoted as part of a grouping of articles. That is, the articles illustrated in FIGS. 1 and 2, or FIGS. 1 and 3, or any other combination thereof, may be marketed as a set of related clothing articles. That is, the design elements 12, 112 and 212 for the various apparel articles may be of a related, or even from the same, event. That is, the integral design elements for such items may be formed from a single jersey or by multiple jerseys worn by the same athlete, or even by members of the same team for a given game or members of the same team for a given season. In any of these cases, the provenances of the pre-worn elements are preferably exposed to the consumer at the point-of-purchase in some way that he or she may make purchasing decisions concerning the items as either individual items or as related groups of items. Alternatively, or in addition, such clothing items may be packaged together such that the consumer is able to purchase a grouping of items with enhanced value.

While it may not necessarily be the case in respect to all purchases, the disclosed clothing articles are intended for wear by the end user. That is, the clothing articles are not intended for sale as collectible items that are thereafter stored. Instead, they are intended to be worn and prominently displayed by purchasers and recipients of these items.

Figure 5:
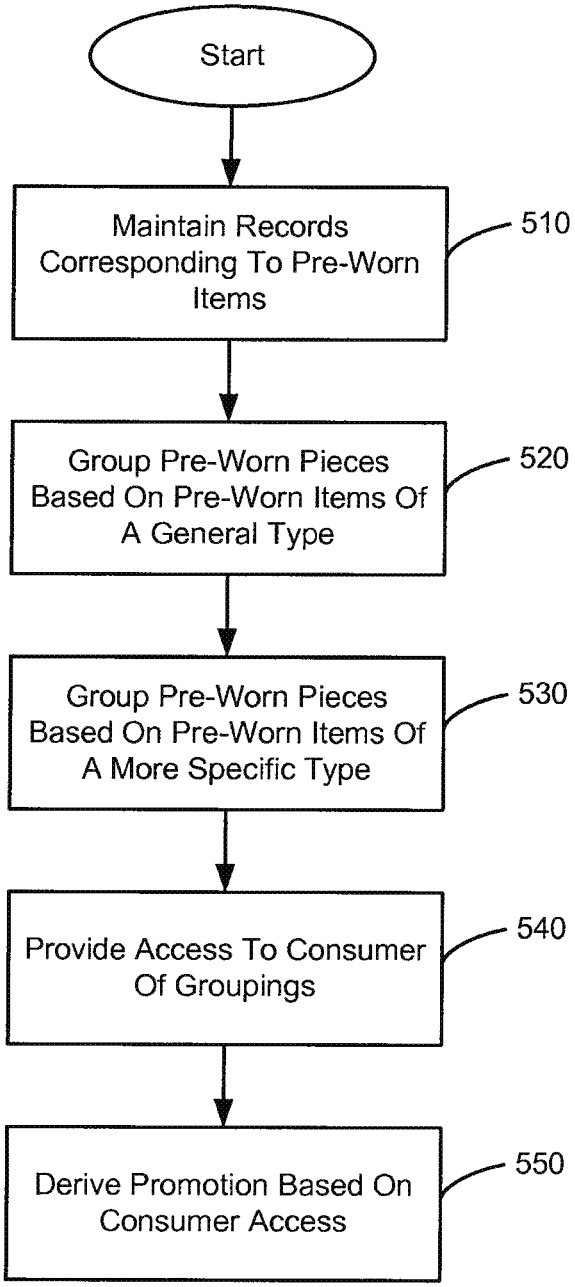
FIG. 5 is a flow chart illustrating a sequence of steps that may be used to market the apparel articles shown in FIGS. 1-4.

The apparel articles according to this disclosure may be marketed in various ways. For example, due to the relatively labor-intensive manner in which provenance information is included on the portion 20 shown in FIG. 4, the manufacturer may simply include an alpha-numeric identifier, such as a serial number, on the tag of the apparel item. In this case, the manufacturer may conceal the serial number from the purchaser at the time of sale of the item. FIG. 5 illustrates one method for marketing apparel items having identifiers of this type according to another aspect of this disclosure. The method illustrated in FIG. 5 is intended to be performed by computer implemented steps by a computing device such as a personal computer, server or otherwise. The disclosed process is executed by such a computing device in an embodiment via the execution of computer-executable instructions, e.g., in machine language form or otherwise, read from a computer-readable medium, e.g., a magnetic or optical disc or other tangible medium.

The process begins and proceeds to a first stage 510 in which records concerning the pre-worn items that are used to create various design elements to be affixed to the apparel articles are maintained by the manufacturer. Such data may include a table with various rows corresponding to an identification of the athlete who wore the pre-worn item, and the date of an event in which the item was worn. Such data may be indexed to other pertinent information concerning the provenance of the pre-worn items. For example, the manufacturer may maintain information concerning the team, opponent and relevant statistics concerning the event. This may be compiled into any suitable form that a consumer may desire.

The method then proceeds to a next stage 520 in which the particular design elements are grouped according to general information concerning the pre-worn items from which the design elements were created. This may include information such as the team of the pre-worn items or the like. At a next stage 530, the method groups particular design elements in accordance with more specific criteria. Such more specific groupings concerning the pre-worn design elements may include particular athletes and/or specific events in which the athletes participated. In addition, such specific information may include the actual location on the pre-worn item that the design element was taken. For example, a record may reveal that the design element was obtained from the shoulder area of a football jersey.

The method then proceeds to a next stage 540 at which access to the grouping records are provided to the consumer of the apparel items. In this case, such access may require the serial number that is located on the apparel item and perhaps another identifier identifying the consumer, such as an email address or other log-in that the user employs during a registration process. By using his personal identifier to log onto the system, the consumer is able to access the pertinent data records concerning a particular apparel article. In this way, the consumer may obtain particular information concerning items he or she purchased.

At a final stage 550, the method may use information concerning the registration and data access by purchasers to derive promotions. For example, the manufacturer may offer other items that may be of interest to the consumer based on the information concerning a design element or elements obtained by a consumer. In this example, the manufacturer may offer other clothing items with design elements taken from the same jersey, or from the pants of the uniform that was worn with the pre-worn item.

It will be appreciated that the foregoing description provides examples of the disclosed article and methods for marketing the same. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

I claim:

1. A method for making an apparel article comprising the steps of:

providing an apparel article;

providing at least one pre-worn piece taken from an indicia-bearing apparel article that was previously worn by an athlete at a sporting event held on a particular date and at a particular place;

affixing the at least one pre-worn piece onto the apparel article so that the entire pre-worn piece covers a portion of the apparel article;

providing a provenance portion located on the finished apparel article and containing an official apparel authentication issued by an official authenticating authority for the particular sport associated with the at least one pre-worn piece and further having a name of the athlete or team, a name of the official authenticating authority for the particular sport associated with the at least one pre-worn piece, and a listing of at least one of the event, date and particular place associated with the at least one pre-worn piece to create an authenticated sports memorabilia item that can be instantaneously identified down to memorabilia details including a specific athlete or team, the authenticating authority, and at least one of the event, date and place associated with the at least one pre-worn piece thereby providing a readily visible provenance portion that not only markets the memorabilia item to the consumer due to the memorabilia details provided thereon, but also allows the consumer to quickly search through a plurality of apparel articles to instantaneously locate a specific item being sought by the consumer and then display the memorabilia details when wearing the specific item.

2. The method of claim 1 wherein affixing the at least one pre-worn piece comprises fastening the at least one pre-worn piece to the apparel article along an outer perimeter of the pre-worn piece.

3. The method of claim 1 wherein providing the at least one pre-worn piece comprises cutting the at least one pre-worn piece out of an athletic jersey having at least one of a logo number and letters associated with a particular athlete or team.

4. The method of claim 1 wherein providing the apparel article comprises providing an apparel article being a different color than the at least one pre-worn piece.

5. The method of claim 4 wherein the color combination of the apparel article and the at least one pre-worn piece match a color combination associated with the specific athlete or team.

6. The method of claim 1 wherein providing the provenance portion comprises positioning the provenance portion on a portion of the apparel article different than a portion of the apparel article having the pre-worn piece.

7. The method of claim 6 wherein providing the provenance portion comprises positioning the provenance portion on a lower body portion of the apparel article and wherein affixing the at least one pre-worn piece comprises affixing the at least one pre-worn piece on a sleeve of the apparel article.

8. The method of claim 1 wherein providing the provenance portion comprises positioning the provenance portion on an exterior surface of the apparel article so that it is readily visible to potential customers.

9. The method of claim 1 wherein affixing the at least one pre-worn piece comprises affixing at least two pre-worn pieces to the apparel article in a pattern.

* * * * *